US005167605A

United States Patent [19]

Wallin et al.

[11] Patent Number: 5,167,605

[45] Date of Patent: Dec. 1, 1992

[54] AUTOMATIC SETTING APPARATUS IN BOX OR CARTON BLANK ERECTION MACHINES

[75] Inventors: Kay Wallin; Ingemar Wilhemsson, both of Halmstad, Sweden

[73] Assignee: Sprinter System AB, Sweden

[21] Appl. No.: 689,760

[22] PCT Filed: Nov. 30, 1989

[86] PCT No.: PCT/SE89/00702
§ 371 Date: May 29, 1991
§ 102(e) Date: May 29, 1991

[87] PCT Pub. No.: WO90/06227
PCT Pub. Date: Jun. 14, 1990

[30] Foreign Application Priority Data

Nov. 30, 1988 [SE] Sweden ..... 8804328

[51] Int. Cl.[5] ..... B31B 3/06

[52] U.S. Cl. ..... 493/122; 493/479

[58] Field of Search ..... 493/122, 123, 167, 316, 493/317, 479

[56] References Cited

U.S. PATENT DOCUMENTS

| | | | |
|---|---|---|---|
| 3,101,654 | 8/1963 | Ullman | 493/122 |
| 4,040,340 | 8/1977 | Iijima | 493/162 |
| 4,061,081 | 12/1977 | Pinto et al. | 493/317 |
| 4,072,090 | 2/1978 | Heisler | 493/313 |
| 4,369,613 | 1/1983 | Gess | 493/478 |
| 4,605,393 | 8/1986 | Krieger et al. | 493/317 |
| 4,674,998 | 6/1987 | Benedicenti | 493/474 |

FOREIGN PATENT DOCUMENTS

| | | |
|---|---|---|
| 2425482 | 12/1975 | Fed. Rep. of Germany . |
| 2615042 | 10/1977 | Fed. Rep. of Germany . |
| 349512 | 10/1972 | Sweden . |
| 424164 | 3/1980 | Sweden . |

*Primary Examiner*—William E. Terrell
*Attorney, Agent, or Firm*—Ostrolenk, Faber, Gerb & Soffen

[57] ABSTRACT

A selection and setting apparatus in box or carton blank erecting machines which enables changing of the blank format in the machine. The apparatus includes format selectors coating with at least two setting wheels. The setting wheels each include at least two pins which are of different lengths enabling settings for different formats. The free ends of these pins contact coacting stops arranged on the erecting tool or carton blank magazine in the machine which are movably settable to the blank size in question.

4 Claims, 2 Drawing Sheets

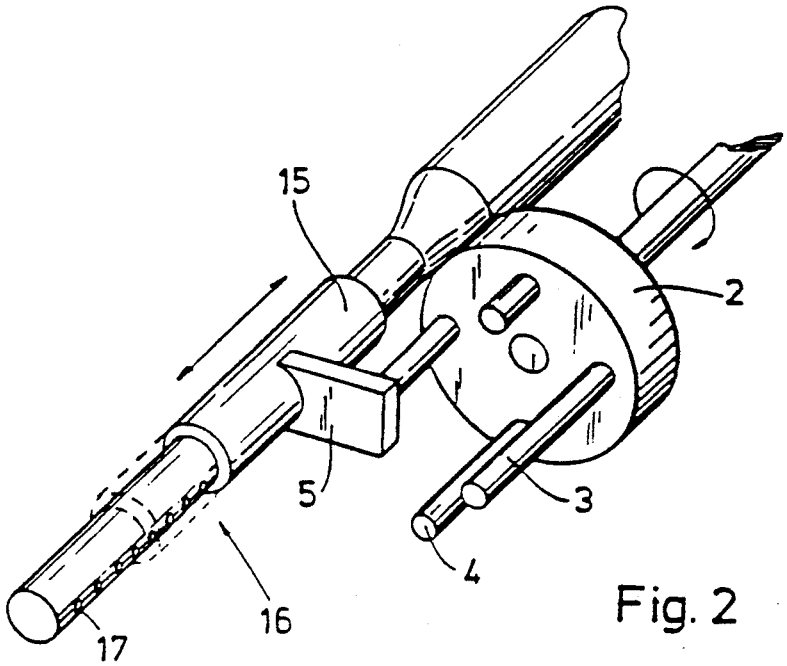
Fig. 2
Fig. 3
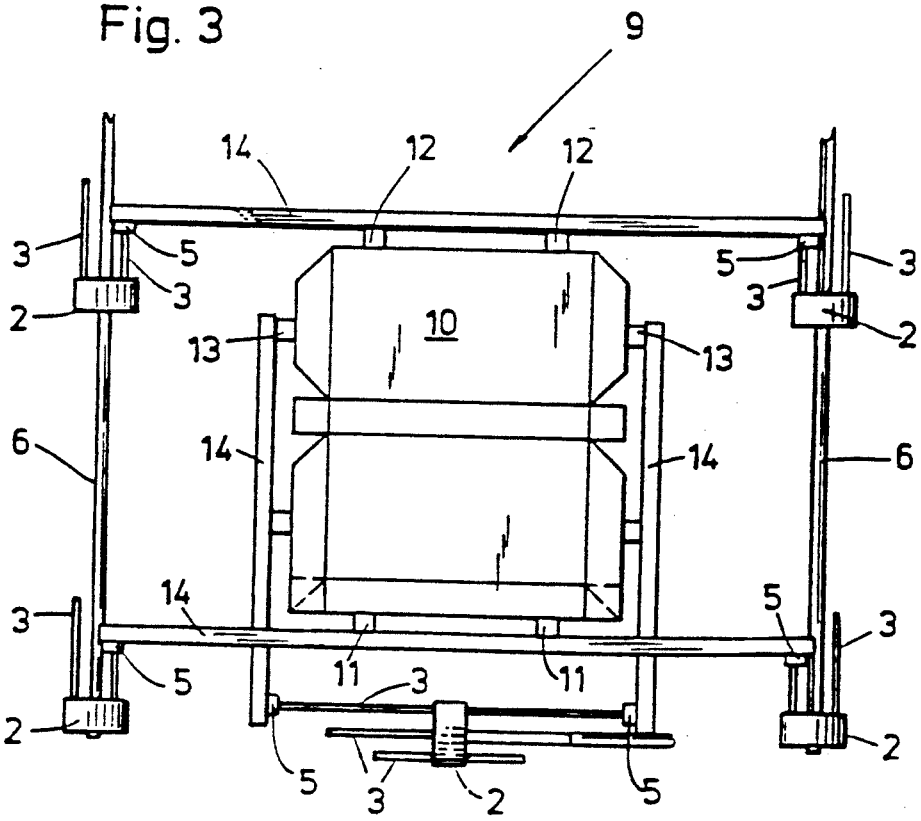

AUTOMATIC SETTING APPARATUS IN BOX OR CARTON BLANK ERECTION MACHINES

BACKGROUND OF THE INVENTION

1. Field of the Invention

The present invention relates to a selecting and setting apparatus in box or carton blank erection machines for enabling the use of different blank formats without changing the actual erecting means in the machine.

2. Description of the Related Art

In changing the blank format in an erection machine, a number of time-consuming operations must be carried out before the machine can be put into service. The tool is usually removed completely, and a new one put in place, and it must be carefully adjusted before starting up. In addition, the magazine used for the blanks must be changed or readjusted so that it fits the new format.

SUMMARY OF THE INVENTION

The object of the present invention is to provide an automatic selecting and setting apparatus in which tool changes and/or magazine changes are no longer necessary for a plurality of formats. The characterizing features essentially distinguishing the invention are disclosed in the accompanying claims.

The present invention provides a means of solving the above described problems occurring in the changing of carton blank formats in erecting machines. Thus, in accordance with the present invention, it is only necessary to turn the selection knobs for selecting the blank width, length and height to the desired one of a plurality of predetermined formats. The exact positions of the tool members are driven by pneumatic cylinders in the erecting machine and are automatically set with the aid of the setting wheels and their respective pins of the apparatus of the present invention. The tool members include stops which engage the free end surfaces of the pins. At the same time, an exact adjustment of the amount of hot air required for positional fixation of the erected blanks is automatically obtained when required by the change in format, by opening or throttling the air nozzles with the aid of sliding sleeves covering their orifices. The sleeves similarly include stops for engaging the free end surfaces of the respective pin on the respective setting wheel.

Other features and advantages of the present invention will become apparent from the following description of the invention which refers to the accompanying drawings.

BRIEF DESCRIPTION OF THE DRAWINGS

The invention will now be described in more detail with reference to the accompanying drawings, where FIG. 2 is a schematic view of the part of the setting apparatus arranged for adjusting a hot air nozzle with respect to the selected blank format, and FIG. 3 is a schematic side view of the setting apparatus for setting up a magazine for the different blank formats.

DETAILED DESCRIPTION OF THE PREFERRED EMBODIMENT

Figure 1:
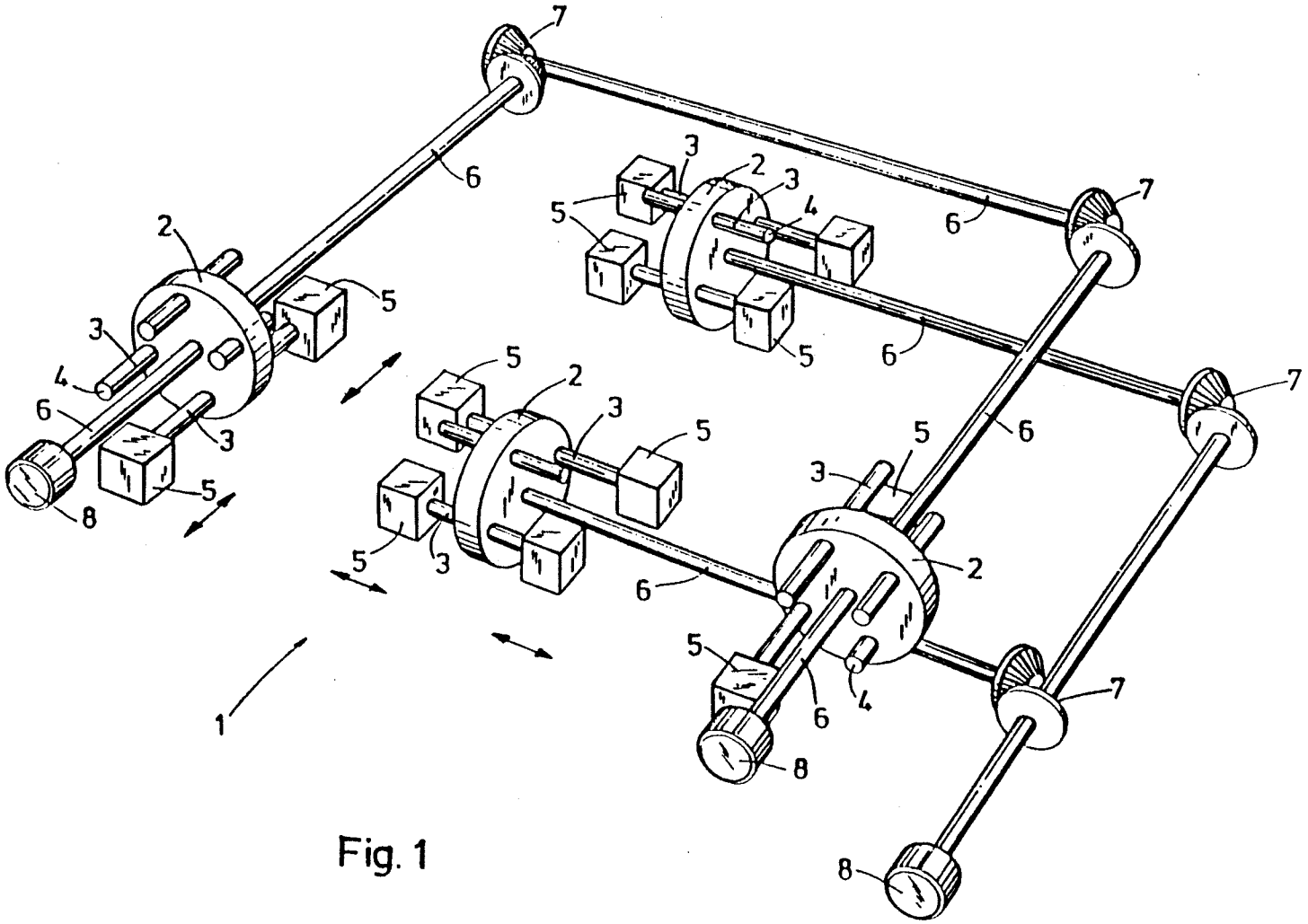
FIG. 1 is a schematic perspective view of a preferred embodiment according to the invention, used for setting up an erection tool in an erecting machine.

As will be seen from the drawings, a preferred embodiment of the setting apparatus 1 includes at least two setting wheels 2, each provided with at least three pins 3. The pins 3 have lengths corresponding to different blank formats, and the free end surfaces 4 of the pins constitute stop surfaces for stops 5 coacting with the pins. These stops 5 are disposed on the tool members in the erecting machine and can be moved to suit the blank size setting. As will be seen from FIG. 1, the setting wheels 2 are actuable by format selection knob 8 via rods 6 and bevel gears 7 for setting width, length and height of a given blank. The rods 6 permit placing of the setting wheels 2 to correspond to the places in the erecting machine enabling coacting with the stops 5 associated with the movable, settable tool members. In this figure, the setting wheels 2 are illustrated as being double-action, i.e. they actuate stops 5 at either end of the pins 3. The pins 3 can thus work in pairs such that the pin 3 may on its left correspond to the width dimension for four different blank formats, while on the right it corresponds to the length dimension for these four formats. As mentioned, the tool members are movable, and with the aid of the pneumatic cylinder or other suitable drive means, they can be thrust out and retracted to maximum and minimum positions, respectively. The maximum position can be regarded as the starting position, since it is to this position that all stops 5 are first thrust when the tool is to be reset to a different format. The stops 5 are maintained at this starting position until the format selection knobs 8 are turned to settings pertaining to a desired format. The pneumatic cylinders thrusting and retracting the movable tool members are then activated, driving the stops 5 towards the minimum position until they meet the free end surfaces 4 of the pins 4 upon which they stop and remain in this position. After the tool members are moved to their starting positions and the format selection knobs are adjusted to a desired blank format, the blank erection machine is then automatically set up for operation.

FIG. 3 schematically illustrates the present invention in use with a magazine 9 for blanks. The procedure described above is also applicable here for setting up the magazine for different blank formats. The blanks 10 are carried by guides 11–13 which are carried by tool members 14. The members 14 are movable and can be set by unillustrated format selection knobs to positions in which the stops coacting with the tool members 14 come into engagement against the pins 3 in the setting wheels 2.

FIG. 2 schematically illustrates a perspective view of a setting wheel 2 for setting a sleeve 15 via a stop 5 and pin 3. The sleeve 15 is displacably arranged around a hot air nozzle 16. This nozzle has round or slot-shaped orifices 17. These nozzles are intended to blow hot air against predetermined regions on the blanks for positionally fixing them in an erected state, using a hot melt technique. The setting position of the sleeve 15 is dependent on the height of the blank. The nozzles 16 are set corresponding to the erected blank simultaneously with stops 5 being set to the selected blank format.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

We claim:

1. A setting apparatus in a carton blank erecting machine for automatically configuring the dimensions of a carton blank magazine to correspond to one of a plurality of predetermined carton blank formats, said setting apparatus comprising:

a plurality of setting wheels, each of said setting wheels having at least two pins extending perpendicularly therethrough, each of said pins having a different length corresponding to a particular predetermined carton blank format dimension, each of said pins having a free end adapted to engage a stop member of said carton blank magazine, whereby when said stop member engages the free end of one of said pins, the length of the engaged pin causes said carton blank magazine to be configured to the dimensions of the corresponding carton blank format; and selecting means connected to said setting wheels for selecting a pin to configure said carton blank magazine to the dimensions of a particular one of said predetermined carton blank formats.

2. A setting apparatus according to claim 1, wherein said setting wheels are connected to rods and said selecting means comprises format selection knobs connected to said rods for rotating said setting wheels via said rods and a plurality of bevel gears to a position which selects the pin corresponding to the desired carton blank format.

3. A setting apparatus according to claim 1, wherein each of said setting wheels has 6–8 pins corresponding to 6–8 carton blank formats.

4. A setting apparatus according to claim 1, further comprising an additional setting wheel having at least two pins extending perpendicularly therethrough, each of said pins having a different length corresponding to a particular predetermined carton blank format dimension, each of said pins having a free end adapted to engage a stop member coupled to a sleeve member which slides over a number of orifices of a hot air nozzle, said additional setting wheel being adapted to be rotated to select a pin for engaging said stop member, whereby the selection of a particular pin in turn causes said sleeve to slide over and cover the number of said orifices corresponding to the desired carton blank format.

* * * * *